US009268288B2

(12) United States Patent
Honda et al.

(10) Patent No.: US 9,268,288 B2
(45) Date of Patent: Feb. 23, 2016

(54) IMAGE FORMING APPARATUS WITH ROTATABLE CURLING CORRECTION PORTION

(71) Applicant: KYOCERA Document Solutions Inc., Osaka-shi, Osaka (JP)

(72) Inventors: Takahiro Honda, Osaka (JP); Kenji Miyamoto, Osaka (JP); Mari Kokomoto, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/334,913

(22) Filed: Jul. 18, 2014

(65) Prior Publication Data

US 2015/0030366 A1 Jan. 29, 2015

(30) Foreign Application Priority Data

Jul. 23, 2013 (JP) ..... 2013-153027

(51) Int. Cl.

| | |
|---|---|
| ***B65H 23/34*** | (2006.01) |
| ***B65H 29/70*** | (2006.01) |
| ***G03G 15/00*** | (2006.01) |
| ***G03G 15/23*** | (2006.01) |
| ***B65H 85/00*** | (2006.01) |
| ***B65H 5/06*** | (2006.01) |
| ***B65H 7/02*** | (2006.01) |

(52) U.S. Cl.

CPC ..... *G03G 15/6576* (2013.01); *B65H 5/062* (2013.01); *B65H 7/02* (2013.01); *B65H 85/00* (2013.01); *G03G 15/235* (2013.01); *B65H 2301/5121* (2013.01); *B65H 2301/51256* (2013.01); *B65H 2511/414* (2013.01); *B65H 2511/52* (2013.01)

(58) Field of Classification Search

CPC ..... G03G 2215/00662; G03G 2215/00945; G03G 12/235; G03G 15/6576; B65H 23/24; B65H 2301/5121; B65H 2301/51256

See application file for complete search history.

(56) References Cited

U.S. PATENT DOCUMENTS

2011/0182642 A1* 7/2011 Nanayama ..... 399/406

FOREIGN PATENT DOCUMENTS

| | | | |
|---|---|---|---|
| JP | 2000229758 | A | 8/2000 |
| JP | 2009029554 | A | 2/2009 |
| JP | 2011173725 | A | 9/2011 |

* cited by examiner

*Primary Examiner* — Blake A Tankersley
*Assistant Examiner* — John M Royston
(74) *Attorney, Agent, or Firm* — Alleman Hall McCoy Russell & Tuttle LLP

(57) ABSTRACT

An image forming apparatus includes an image forming portion, a curling correction portion, a curling direction determination portion, and a rotation control portion. The image forming portion forms an image on a recording medium. The curling direction determination portion determine a direction of curling in a recording medium in which images forms on both surfaces thereof, based on an image density of each of both surfaces of the recording medium in which the images forms on both surfaces thereof. The rotation control portion is configured to rotate the curling correction portion such that the curling correction portion is set in an orientation for correcting the curling that has occurred in the recording medium, in a direction opposite to the direction of the curling determined by the curling direction determination portion.

3 Claims, 8 Drawing Sheets

IMAGE FORMING APPARATUS WITH ROTATABLE CURLING CORRECTION PORTION

INCORPORATION BY REFERENCE

This application is based upon and claims the benefit of priority from the corresponding Japanese Patent Application No. 2013-153027 filed on Jul. 23, 2013, the entire contents of which are incorporated herein by reference.

BACKGROUND

The present disclosure relates to an image forming apparatus including a curling correction portion for correcting curling that has occurred in a recording medium when image formation is performed.

In image forming apparatuses such as a printer, a copy machine, and a FAX apparatus, toner forming a toner image formed on a surface of a print sheet (recording medium) is heated and melted, and further, the print sheet is pressurized, whereby the image is fixed on the print sheet. Since the print sheet after the fixation has been heated, curling may occur upwardly or downwardly in the print sheet. In particular, curling tends to occur in an end portion of the print sheet on the upstream side in the conveying direction thereof and in an end portion of the print sheet on the downstream side in the conveying direction. This curling may cause defective conveyance which results in a jam, defective load of print sheets having been discharged, and the like. Thus, devices that correct curling having occurred in a print sheet have been known. For example, there has been known a curling removing device that can change the direction in which curling is to be corrected based on the curling direction thereof.

SUMMARY

An image forming apparatus according to one aspect of the present disclosure includes an image forming portion, a reverse conveyance portion, a curling correction portion, a rotation support portion, a driving portion, a curling direction determination portion, and a rotation control portion. The image forming portion is configured to form an image on either one of a first surface and a second surface of a conveyed recording medium. The reverse conveyance portion is configured to reverse front and back of the recording medium after an image is formed on the first surface of the recording medium by the image forming portion, and convey the recording medium to the image forming portion in order to form an image on the second surface opposite to the first surface. The curling correction portion includes one pair of rollers composed of members that respectively have different elasticities and are pressed against each other, and is configured to correct curling that has occurred in the recording medium on which image formation has been performed by the image forming portion, by conveying the recording medium while nipping the recoding medium by the roller pair. The rotation support portion supports the curling correction portion such that the curling correction portion is rotatable about a rotation shaft parallel to a shaft of each roller of the roller pair in such a manner as to allow positions of the rollers to be reversed. The driving portion is configured to rotate the rotation support portion. The curling direction determination portion is configured to determine a direction of curling in the recording medium to which images are been formed on both surfaces thereof by the image forming portion, based on an image density of each of both surfaces of the recording medium to which the images are been formed on both surfaces thereof. The rotation control portion is configured to control drive of the driving portion to rotate the curling correction portion such that the curling correction portion is set in an orientation for correcting the curling that occurs in the recording medium, in a direction opposite to the direction of the curling determined by the curling direction determination portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the drawings.

Figure 1:
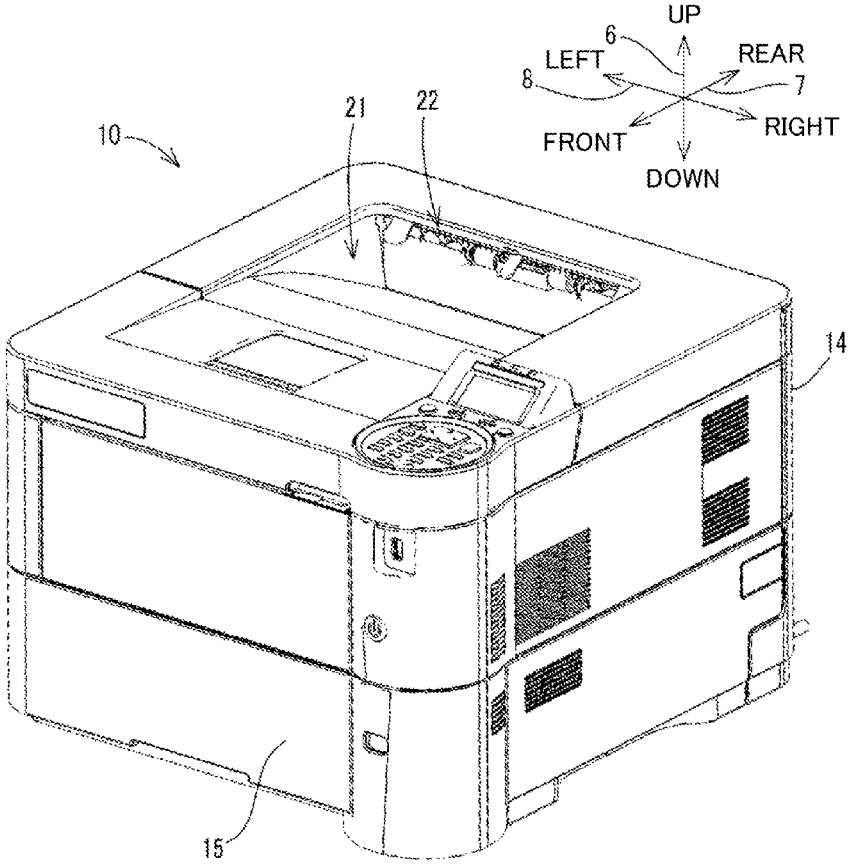
FIG. 1 shows a structure of an image forming apparatus according to an embodiment of the present disclosure.
Figure 2:
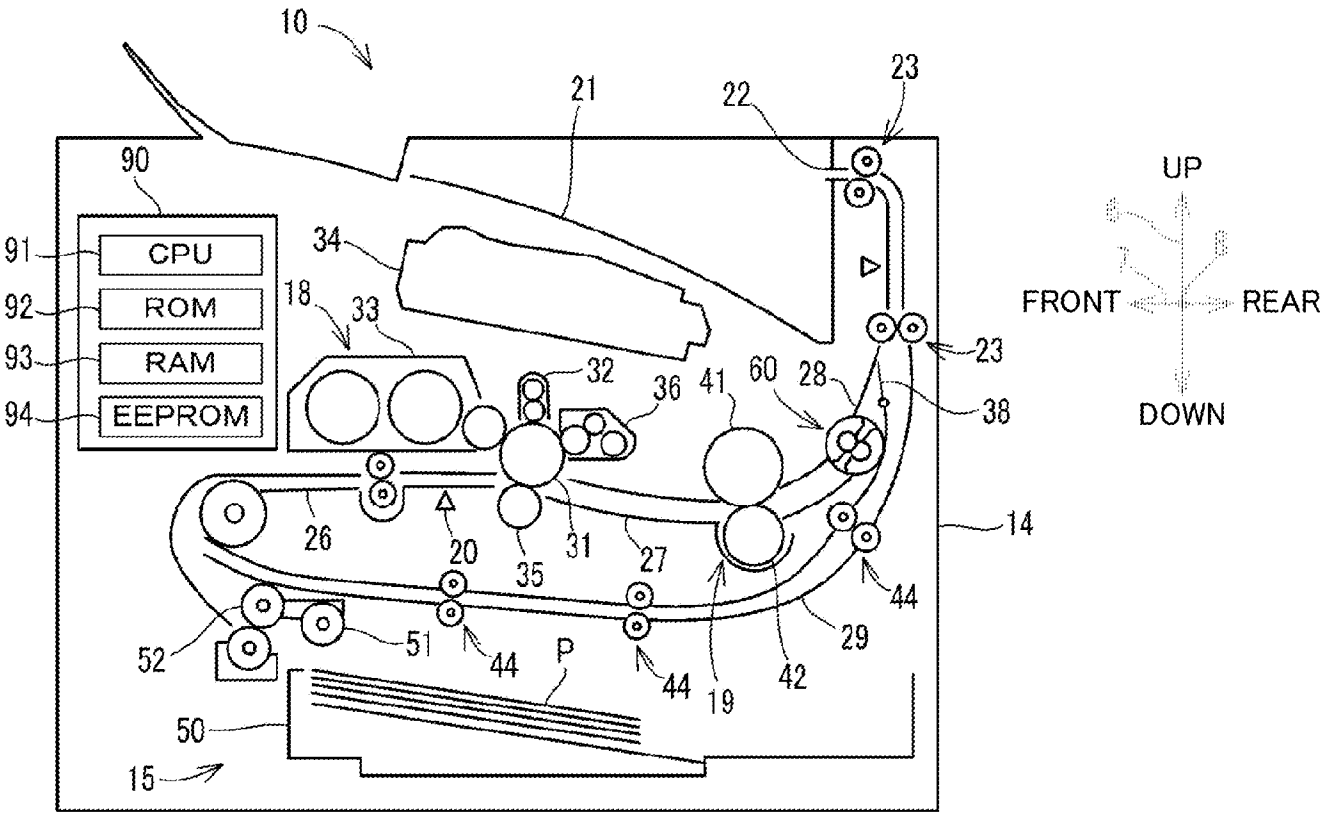
FIG. 2 shows a structure of a cross section of the image forming apparatus shown in FIG. 1.

FIG. 1 and FIG. 2 each show a structure of an image forming apparatus 10 according to an embodiment of the present disclosure. The image forming apparatus 10 is one example of an image forming apparatus of the present disclosure. In the following description, an up-down direction 6 is defined based on a state (the state shown in FIG. 1) in which the image forming apparatus 10 is installed so as to be usable, a front-rear direction 7 is defined with the near side (front face side) set as the front, and a left-right direction 8 is defined when the image forming apparatus 10 is viewed from the near side (front face side).

[Structure of the Image Forming Apparatus 10]

As shown in FIG. 1, the image forming apparatus 10 is a printer. The image forming apparatus 10 prints inputted image data on a print sheet P (one example of recording medium) formed from a vegetable fiber such as pulp, by use of a print material such as toner. The image forming apparatus 10 is not limited to a printer, and the present disclosure is also applicable to a dedicated machine such as a facsimile or a copy machine.

The image forming apparatus 10 prints an image on a print sheet P based on image data inputted from the outside via a network communication portion not shown. For example, upon receiving a printing job from an apparatus such as a personal computer, the image forming apparatus 10 prints an image on a print sheet P based on image data and a printing condition indicated by the printing job. Alternatively, the image forming apparatus 10 prints an image on a print sheet P based on image data read by a scanner not shown.

As shown in FIG. 1 and FIG. 2, the image forming apparatus 10 mainly includes an image forming portion 18 (one example of an image forming portion of the present disclosure) of an electrophotographic type, a fixing portion 19, a sheet feed device 15, a curling correction portion 60 (one example of a curling correction portion of the present disclosure), a paper sheet sensor 20, a control portion 90, and the like. The image forming apparatus 10 also includes a conveyance motor 56 and a discharge motor 57 (see FIG. 5). These are disposed inside a housing 14 which forms a cover of the outer frame and an inner frame 16 (see FIG. 4) of the image forming apparatus 10.

As shown in FIG. 2, the sheet feed device 15 is provided in a lowermost part of the image forming apparatus 10. The sheet feed device 15 includes a paper sheet tray 50, a pickup roller 51, and a sheet feed roller 52. The paper sheet tray 50 accommodates a print sheet P onto which an image is formed by the image forming portion 18. The paper sheet tray 50 is supported by the housing 14. The pickup roller 51 and the sheet feed roller 52 are provided above the front side of the paper sheet tray 50. Upon input of an instruction for the image forming apparatus 10 to start a sheet feeding operation of a print sheet P, the conveyance motor 56 (see FIG. 5) is driven to rotate. Accordingly, the pickup roller 51 and the sheet feed roller 52 are rotated. Then, the print sheet P is fed from the paper sheet tray 50 by the pickup roller 51. The print sheet P fed by the pickup roller 51 is conveyed to the downstream side in the feed direction of the print sheet P by the sheet feed roller 52. Specifically, when the print sheet P is sent out upwardly by the sheet feed roller 52, the print sheet P passes through a conveyance path 26 extending from the sheet feed roller 52 to the image forming portion 18, and thus its feeding direction is changed to the backward (rear side of the image forming apparatus 10), and then is conveyed toward the image forming portion 18.

The conveyance path 26 is provided with the paper sheet sensor 20. In detail, the paper sheet sensor 20 is disposed, in the conveyance path 26, upstream of a transfer portion 35 of the image forming portion 18. The paper sheet sensor 20 detects the leading end of the print sheet P passing through the conveyance path 26, and is, for example, a light sensor of a light-emitting type. When the leading end of the print sheet P passes a position, in the conveyance path 26, that corresponds to the arrangement position of the paper sheet sensor 20, a signal to be outputted from the paper sheet sensor 20 to the control portion 90 is changed. By receiving this change in the signal, the control portion 90 can determine the position of the leading end of the print sheet P.

Based on the inputted image data, the image forming portion 18 forms an image on either one of both surfaces of the print sheet P conveyed in the conveyance path 26. The image forming portion 18 transfers a toner image on the print sheet P by use of a print material such as toner. Specifically, as shown in FIG. 2, the image forming portion 18 includes a photosensitive drum 31, a charging portion 32, a developing portion 33, an LSU (Laser Scanning Unit) 34, the transfer portion 35, and a cleaning portion 36. The photosensitive drum 31 is disposed above the conveyance path 26. Upon start of an image forming operation, the surface of the photosensitive drum 31 is charged at a uniform potential by the charging portion 32. Further, the LSU 34 scans the photosensitive drum 31 with a laser beam in accordance with the image data. As a result, an electrostatic latent image is formed on the photosensitive drum 31. Then, toner is adhered to the electrostatic latent image by the developing portion 33, and the toner image is formed on the photosensitive drum 31. Then, the toner image is transferred, by the transfer portion 35, to the print sheet P conveyed through the conveyance path 26. At that time, the toner image is transferred onto a surface facing the photosensitive drum 31 (the upper surface of the print sheet P being conveyed in the conveyance path 26). The print sheet P on which the toner image has been transferred is sent out to a conveyance path 27 extending from the image forming portion 18 to the fixing portion 19. Then, the print sheet P is conveyed to the fixing portion 19 disposed downstream (i.e., to the rear side) of the image forming portion 18, in the conveying direction of the print sheet P.

The fixing portion 19 fixes the toner image transferred to the print sheet P, onto the print sheet P with heat. The fixing portion 19 includes a heating roller 41 and a pressurizing roller 42. The pressurizing roller 42 is urged toward the heating roller 41 side by means of an elastic member such as a spring. Accordingly, the pressurizing roller 42 is pressed against the heating roller 41. The heating roller 41 is heated to high temperature by a heating portion such as a heater during the fixing operation. While the print sheet P passes through the fixing portion 19, the toner forming the toner image is heated to melt by the heating roller 41, and further the print sheet P is pressurized by the pressurizing roller 42. As a result, the toner is fixed on the print sheet P by the fixing portion 19. Accordingly, the toner image is fixed on the print sheet P, whereby an image is formed on the print sheet P.

In the fixing portion 19, the print sheet P is conveyed while being heated to high temperature and pressurized. This may cause curling of the print sheet P. Curling includes upward curling toward the upper surface side of the print sheet P and downward curling toward the lower surface side of the print sheet P, when viewed in FIG. 2. The direction of curling changes depending on, for example, the density of the image formed on the print sheet P, that is, the amount of toner fixed on the print sheet P. For example, in a case where one-side printing in which an image is formed on only one side of a print sheet P, is performed, toner is fixed on only one side thereof. Therefore, when the melted toner hardens, the print sheet P tends to curl toward the image formation surface on which the toner has been fixed. When double-sided printing in which images are formed on both sides of a print sheet P, is performed, the direction of curling changes depending on the densities of the images on the respective surfaces. For example, the print sheet P tends to curl toward a surface having a higher density, that is, toward a surface on which the amount of toner is larger. The magnitude of curling tends to be greater as the image density is higher, and tends to be smaller as the image density is lower. It should be noted that the curling of the print sheet P is corrected by the curling correction portion 60 described below provided in a conveyance path 28.

The conveyance path 28 is provided downstream of the fixing portion 19, in the conveying direction of the print sheet P. At the terminal end of the conveyance path 28, a sheet outlet 22 through which the print sheet P is discharged is provided. That is, the conveyance path 28 is provided from the fixing portion 19 to the sheet outlet 22. The print sheet P on which an image has been fixed by the fixing portion 19 is conveyed into the conveyance path 28. The conveyance path 28 is curved upwardly from the fixing portion 19 and then extends straight upwardly in the vertical direction. The conveyance path 28 is provided with a plurality of discharge roller pairs 23 to be rotated in either direction by the discharge motor 57 (see FIG. 5). The print sheet P conveyed into the conveyance path 28 is conveyed upwardly through the conveyance path 28 by the discharge roller pairs 23 which are caused to operate in forward rotation by the discharge motor 57, and then is discharged from the sheet outlet 22 into a sheet discharge portion 21 provided on the upper surface of the image forming apparatus 10.

When one-side printing is performed in the image forming apparatus 10, the print sheet P having an image formed on one side thereof by the image forming portion 18 sequentially passes through the fixing portion 19 and the curling correction portion 60, and then passes through the conveyance path 28 to be discharged from the sheet outlet 22 into the sheet discharge portion 21.

On the other hand, when double-sided printing is performed in the image forming apparatus 10, the print sheet P first having an image formed on one side thereof passes through the fixing portion 19 and the curling correction portion 60, and then is again conveyed from the downstream side in the conveying direction of the print sheet P, into the reverse direction, with the front and back sides of the print sheet P reversed. Then, in order to form an image on the surface opposite to the one side, the print sheet P is conveyed to the image forming portion 18 again. In detail, in a state where the leading end of the print sheet P having an image formed on one side thereof is exposed from the sheet outlet 22 to the outside, rotation of the discharge roller pairs 23 are stopped. At this time, the trailing end of the print sheet P is held while being nipped by the discharge roller pair 23 that is near the sheet outlet 22. Thereafter, the discharge roller pairs 23 are rotated reversely by reverse rotation drive of the discharge motor 57 (see FIG. 5), whereby the print sheet P is again conveyed in the conveyance path 28 in the reverse direction. That is, the print sheet P is reversely conveyed in the conveyance path 28. As shown in FIG. 2, a reverse conveyance path 29 is formed in the image forming apparatus 10. The reverse conveyance path 29 is a conveyance path which branches from the conveyance path 28 and connects to the conveyance path 26 which is on the upstream side in the conveying direction of the print sheet P when viewed from the image forming portion 18.

At the branch point between the conveyance path 28 and the reverse conveyance path 29, a flap 38 is provided which has a film-like shape and which guides the print sheet P being reversely conveyed, into the reverse conveyance path 29. The print sheet P reversely conveyed in the conveyance path 28 is guided by the flap 38 from the conveyance path 28 into the reverse conveyance path 29. The reverse conveyance path 29 is provided with a plurality of conveyance roller pairs 44. The print sheet P passes through the reverse conveyance path 29 by means of the conveyance roller pairs 44, to be conveyed to the image forming portion 18 again via the conveyance path 26. At that time, the print sheet P is conveyed in the conveyance path 26 toward the image forming portion 18 in a state where the surface thereof on which the image has already been formed is located on the lower side and the surface thereof on which no image has been formed yet is located on the upper side. The print sheet P having reached the image forming portion 18 passes through the image forming portion 18 and the fixing portion 19, whereby an image is formed on the opposite side surface thereof where no image has been formed. Thereafter, the print sheet P having images formed on both sides thereof passes through the curling correction portion 60, then passes through the conveyance path 28 by means of the discharge roller pairs 23 whose rotation direction has been returned to the forward rotation direction, and then, is discharged from the sheet outlet 22 to the sheet discharge portion 21. The reverse conveyance path 29 and the conveyance roller pairs 44 for reversing the front and back sides of the print sheet P and conveying the print sheet P again to the upstream side of the image forming portion 18 in the conveying direction of the print sheet P are one example of a reverse conveyance portion of the present disclosure.

[Curling Correction Portion 60]

Figure 3B:
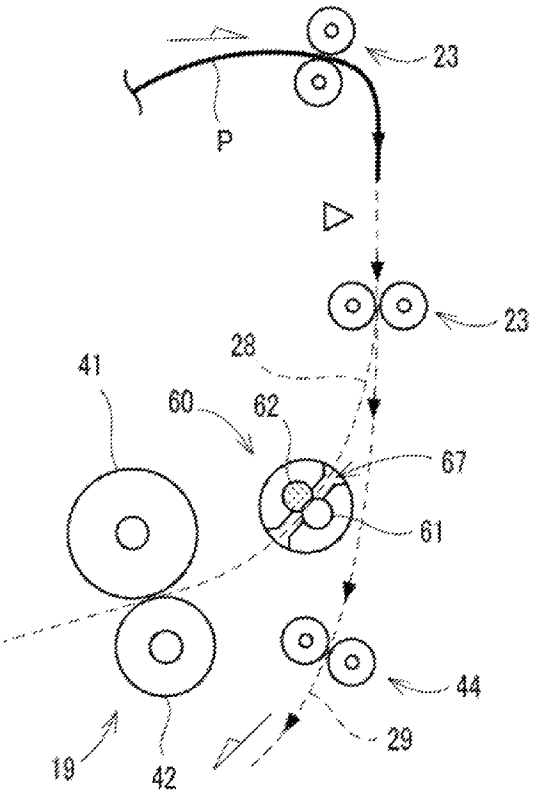
FIG. 3A and FIG. 3B each show a structure of a vicinity of a curling correction portion of the image forming apparatus shown in FIG. 1.
Figure 3A:
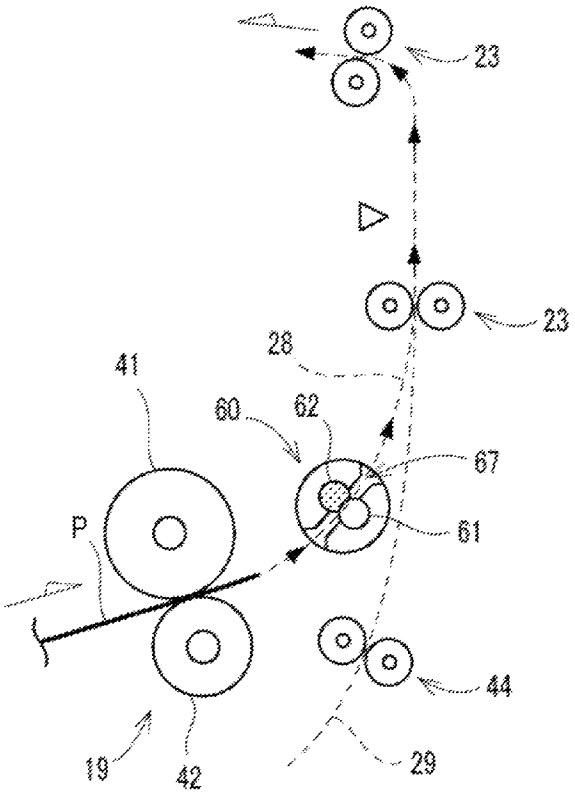

Next, the structure of the curling correction portion 60 will be specifically described. As shown in FIG. 3A and FIG. 3B, the curling correction portion 60 is provided in the conveyance path 28. More in detail, the curling correction portion 60 is provided, in the conveyance path 28, between the fixing portion 19 and the branch point of the reverse conveyance path 29. The curling correction portion 60 corrects curling that has occurred in a print sheet P on which the image formation has been performed by the image forming portion 18 and the fixing portion 19.

Figure 4:
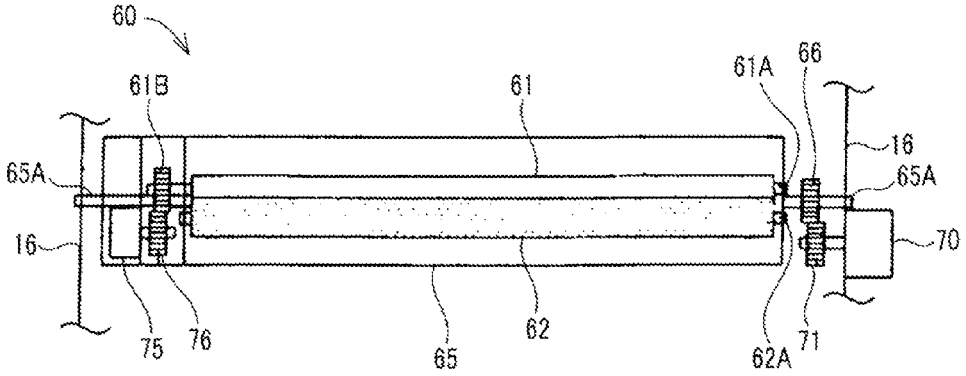
FIG. 4 shows a structure of the curling correction portion of the image forming apparatus shown in FIG. 1.

As shown in FIG. 4, the curling correction portion 60 includes a hard roller 61, a soft roller 62, and a casing 65. The hard roller 61 and the soft roller 62 are one example of one roller pair of the present disclosure. The hard roller 61 and the soft roller 62 are respectively formed from members having different elasticities, and are pressed against each other. When the print sheet P having an image formed thereon by the image forming portion 18 and the fixing portion 19 advances the portion where the hard roller 61 and the soft roller 62 are pressed against each other, the hard roller 61 and the soft roller 62 nip the print sheet P and convey it. Accordingly, curling that has occurred in the print sheet P is corrected.

The hard roller 61 is made of a material harder than that of the soft roller 62, i.e., for example, a hard material such as metal. The soft roller 62 is made of a flexible and elastic material such as synthetic resin. The casing 65 houses the hard roller 61 and the soft roller 62. A shaft 61A of the hard roller 61 and a shaft 62A of the soft roller 62 are parallel to each other. Each of the shafts 61A and 62A is rotatably supported by bearings (not shown) provided in the casing 65. The periphery of the hard roller 61 is pressed against the periphery of the soft roller 62. Thus, a portion of the soft roller 62 against which the hard roller 61 is pressed is recessed in an arc shape by the hard roller 61. Therefore, when the print sheet P is conveyed by the hard roller 61 and the soft roller 62 while being nipped therebetween, the print sheet P is deformed into an arc shape in the direction opposite to the direction of the curling, whereby it is possible to correct the curling that has occurred in the print sheet P.

In the casing 65, a conveyance path 67 extending in the diameter direction thereof (see FIG. 3A and FIG. 3B) is formed. The conveyance path 67 is formed in a size and a width that allow a curled print sheet P to advance therethrough. The openings, which are on both sides of the conveyance path 67 and which serve as an inlet and an outlet for the print sheet P to and from the conveyance path 67 are each formed in a funnel-like diverging shape. In a middle portion of the conveyance path 67, the hard roller 61 and the soft roller 62 protrude so as to be pressed against each other.

The casing 65 of the curling correction portion 60 includes shafts 65A which is parallel to the shafts 61A and 62A. The curling correction portion 60 is rotatably supported about the shaft 65A so as to be capable of reversing arrangement of the hard roller 61 and the soft roller 62. Specifically, the casing 65 of the curling correction portion 60 is rotatably supported by the inner frame 16 of the image forming apparatus 10, via the shafts 65A which are provided at the center of the both sides of casing 65 and which extends outwardly therefrom. In other words, the curling correction portion 60 is supported by the shaft 65A and the inner frame 16, which supports the shaft 65A, so as to be rotatable about the shaft 65A. Thus, when a driving force is externally transmitted to the curling correction portion 60, the curling correction portion 60 rotates about the shaft 65A. It should be noted that the support mechanism including the shaft 65A and the inner frame 16, which supports the shaft 65A, is an example of a rotation support portion of the present disclosure.

To one of the shafts 65A, a gear 66 is mounted. To the inner frame 16, a casing rotation motor 70 (one example of a drive portion of the present disclosure) is mounted. The casing rotation motor 70 supplies a rotary-driving force to the curling correction portion 60 to rotate the curling correction portion 60 about the shaft 65A. To the output shaft of the casing rotation motor 70, a gear 71 is mounted, and the gear 71 is meshed with the gear 66. Accordingly, when the casing rotation motor 70 is driven to rotate, the casing 65 is rotated about the shaft 65A, with the hard roller 61 and the soft roller 62 housed therein.

To one end portion of the shaft 61A of the hard roller 61, a gear 61B is mounted. To the casing 65, a hard roller rotation motor 75 is mounted. The hard roller rotation motor 75 rotates the hard roller 61 about the shaft 61A. To the output shaft of the hard roller rotation motor 75, a gear 76 is mounted, and the gear 76 is meshed with the gear 61B. Accordingly, when the hard roller rotation motor 75 is driven to rotate, the hard roller 61 is rotated.

As described above, the soft roller 62 is rotatably supported by the casing 65 and is pressed against the hard roller 61. Thus, the soft roller 62 is rotated so as to follow (rotated together with) the rotation of the hard roller 61 in a state where the portion thereof that contacts the hard roller 61 is recessed in an arc shape. In the present embodiment, of the one pair of rollers, only the hard roller 61 is supplied with drive force. Thus, compared with a structure in which both the hard roller 61 and the soft roller 62 are supplied with drive force to rotate, the structure of the present embodiment is simple. The hard roller rotation motor 75 being the drive source is provided inside the casing 65, and thus, also from this point, the curling correction portion 60 of the present disclosure is compact and structurally simple.

Further, the curling correction portion 60 also has a function of guiding conveyance of the print sheet P. Thus, as shown in FIG. 3A and FIG. 3B, the curling correction portion 60 is provided downstream of the fixing portion 19 in the conveying direction of the print sheet P. The print sheet P having been conveyed from the fixing portion 19 advances into the conveyance path 67 in the casing 65, and is further conveyed to the downstream side in the conveying direction of the print sheet P while being nipped by the hard roller 61 and the soft roller 62.

As described above, the curling correction portion 60 is rotatably supported about the shaft 65A so as to be capable of reversing arrangement of the hard roller 61 and the soft roller 62. In the present embodiment, the direction of curling in the print sheet P is accurately determined by a later-described curling correction process being executed by the control portion 90. Then, the curling correction portion 60 is changed to either one of a predetermined first orientation and a predetermined second orientation such that it is possible to correct the curling in the print sheet P. Specifically, the curling correction portion 60 is rotated between the first orientation (an orientation shown in FIG. 3) in which the soft roller 62 is positioned on the heating roller 41 side and the second orientation in which the hard roller 61 is positioned on the heating roller 41 side. It should be noted that the curling correction process will be described later.

[Configuration of the Control Portion 90]

The control portion 90 performs overall control of the image forming apparatus 10. As shown in FIG. 2, the control portion 90 includes a CPU 91, a ROM 92, a RAM 93, an EEPROM 94, and the like. It should be noted that the control portion 90 may be structured as an electronic circuit such as an integrated circuit (ASIC, DSP).

Figure 5:
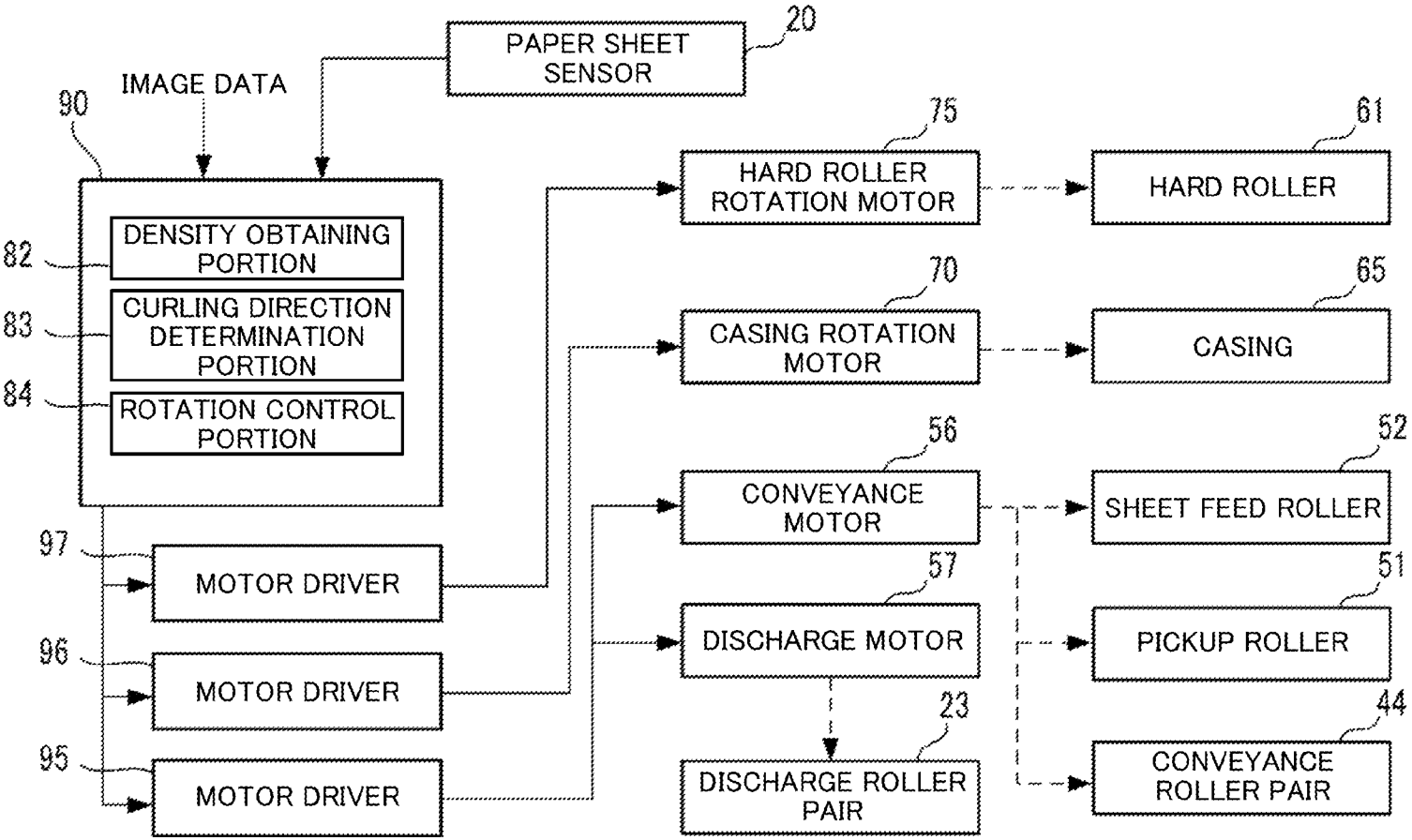
FIG. 5 is a block diagram showing a configuration of a control portion of the image forming apparatus shown in FIG. 1.

The control portion 90 is connected to the image forming portion 18, the fixing portion 19, the sheet feed device 15, and the like, inside the image forming apparatus 10, and controls these components. Also, as shown in FIG. 5, the control portion 90 is connected to motor drivers 95 to 97. The motor driver 95 controls a rotation direction and a rotation speed of each of the conveyance motor 56 and the discharge motor 57, upon receiving a control signal from the control portion 90. The motor driver 96 controls a rotation direction and a rotation speed of the casing rotation motor 70, upon receiving a control signal from the control portion 90. The motor driver 97 controls a rotation direction and a rotation speed of the hard roller rotation motor 75, upon receiving a control signal from the control portion 90.

In the present embodiment, the control portion 90 functions as a density obtaining portion 82, a curling direction determination portion 83, and a rotation control portion 84 (see FIG. 5) by a control program in the ROM 92 being executed by the CPU 91.

Figure 6:
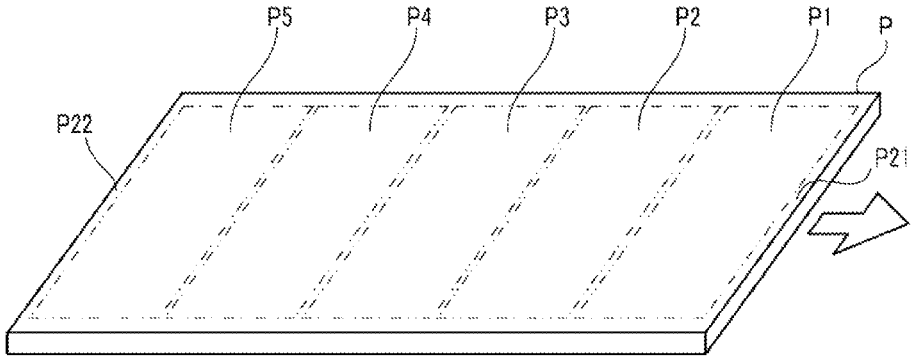
FIG. 6 is a diagram for explaining division areas on a print sheet whose density values are obtained by the control portion shown in FIG. 5.

The density obtaining portion 82 calculates a density value of an image for each of areas P1 to P5 (see FIG. 6, an example of division areas of the present disclosure) obtained by dividing an image formation surface of the print sheet P into a plurality of sections. Accordingly, the density obtaining portion 82 obtains a density value of an image for each of the areas P1 to P5. In the present embodiment, as shown in FIG. 6, in the print sheet P, a plurality of the areas P1 to P5 are defined by dividing the print sheet P into five sections from an end portion P21 (corresponding to a first end portion of the present disclosure) on the downstream side to an end portion P22 (corresponding to a second end portion of the present disclosure) on the upstream side in a conveying direction (the direction of an outlined arrow) in which the print sheet P is conveyed by the hard roller 61 and the soft roller 62 of the curling correction portion 60. The density obtaining portion 82 obtains the density value of the image for each of the areas P1 to P5. Regarding the density value of the image, it is possible to obtain an image density from image data inputted when image formation is performed. The obtained density value of each of the areas P1 to P5 is temporarily stored in the RAM 93. Here, portions surrounded by alternate long and two short dashes lines in FIG. 6 are the areas P1 to P5.

The curling direction determination portion 83 determines the direction of curling in the print sheet P on which image formation has been performed. Specifically, when one-side printing is performed, an image is formed on only an image formation surface by the one-side printing. Thus, the curling direction determination portion 83 determines that the print sheet P curls toward the surface on which the image has been formed.

In addition, the curling direction determination portion 83 determines the direction of curling in the print sheet P in which images are formed on both surfaces thereof by the image forming portion 18. Specifically, the curling direction determination portion 83 determines the direction of curling in the print sheet P in which images are formed on both surfaces thereof, based on an image density of each of both surfaces of the print sheet P. In general, when double-sided printing is performed, the print sheet P tends to curl toward the surface having a higher image density, of both surfaces on which images have been formed. Thus, since the curling direction determination portion 83 is able to obtain the image density of each of both surfaces from inputted image data, the curling direction determination portion 83 determines the surface having a higher image density by comparing the image densities (density values) of both surfaces to each other, and determines that the print sheet P has curled toward that surface having a higher image density.

Figure 7A:
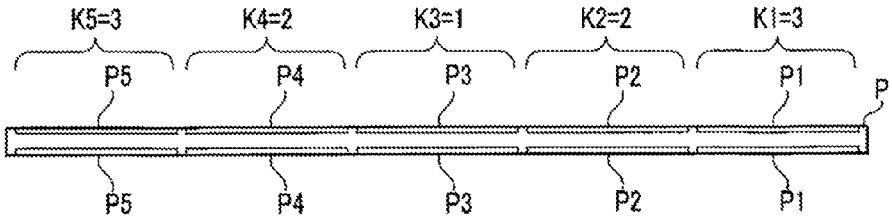
FIGS. 7A to 7C show a diagram for explaining a weight coefficient for each division area shown in FIG. 6.

In the present embodiment, as shown in FIG. 7A, the image formation surface of the print sheet P is previously divided into a plurality of areas P1 to P5. Specific weight coefficients K1 to K5 are set so as to correspond to the areas P1 to P5 of the image formation surface of the print sheet P, respectively. For example, the weight coefficient for the area P1 is K1; the weight coefficient for the area P2 is K2; the weight coefficient for the area P3 is K3; the weight coefficient for the area P4 is K4; and the weight coefficient for the area P5 is K5. In this case, the curling direction determination portion 83 obtains a later-described determination value for each area in each surface of the print sheet P having images formed on both surfaces thereof, obtains a total value of the determination values of the respective areas for each of both surfaces of the print sheet P, and determines, as the direction of curling, the direction in which the surface having a higher total value faces.

Here, the determination value is obtained for each of the areas P1 to P5. Specifically, the determination value is a value obtained by multiplying the density value of the image of each of the areas P1 to P5, which is obtained by the density obtaining portion 82, by one of the weight coefficients K1 to K5 corresponding to each area. For example, the determination value of the area P1 is a value obtained by multiplying the density value of the area P1 by the weight coefficient K1. Similarly, the determination value of the area P2 is a value obtained by multiplying the density value of the area P2 by the weight coefficient K2. The determination values are obtained for each of both surfaces of the print sheet P.

In view of the fact that both end portions on the upstream side and the downstream side in the conveying direction of the print sheet P are likely to curl as compared to a center portion in the conveying direction, the weight coefficients K1 to K5 are set to become higher from the area P3 at the center portion in the conveying direction toward both end portions in the conveying direction. Specifically, as shown in FIG. 7A, the weight coefficient K3 is set at "1"; the weight coefficients K2 and K4 are set at "2"; and the weight coefficients K1 and K5 are set at "3". These weight coefficients K1 to K5 are stored in the EEPROM 94 of the control portion 90.

Figure 7B:
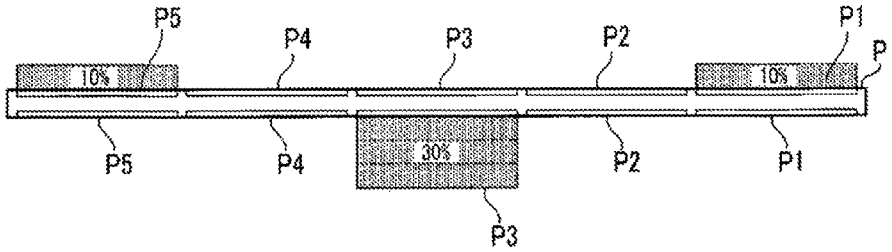
Figure 7C:
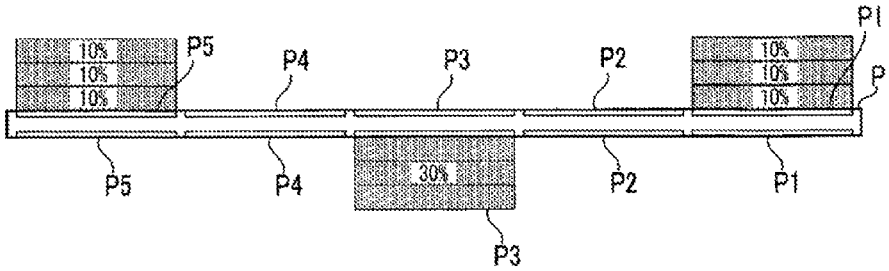

For example, an image example will be considered in which, as shown in FIG. 7B, an image having a density level of 10% is formed on each of the areas P1 and P5 of the upper surface of the print sheet P and an image having a density level of 30% is formed on the area P3 of the lower surface of the print sheet P. In this image example, when a total value of the determination values of each of both surfaces is obtained without taking the weight coefficients K1 to K5 into consideration, the total value of the lower surface is higher. Therefore, in this case, the curling direction determination portion 83 determines that the print sheet P has curled toward the lower surface side. However, in the image example shown in FIG. 7B, on the lower surface of the print sheet P, the image having a density level of 30% is formed on the area P3 at which the print sheet P is most difficult to curl, and on the upper surface of the print sheet P, the image having a density level of 10% is formed on each of the areas P1 and P5 at which the print sheet P is easiest to curl. Thus, the direction of actual curling in the print sheet P is more likely to be a direction toward the upper surface side. Therefore, in the present embodiment, as described above, a total value of the determination values of each of both surfaces of the print sheet P is obtained by reflecting the weight coefficients K1 to K5, and the direction of curling is determined. Specifically, in the case of the image example shown in FIG. 7B, determination values "30%" each obtained by multiplying the density level 10% of each of the areas P1 and P5 of the upper surface of the print sheet P by the weight coefficient "3" are combined to obtain a total value "60%" of the determination values of the upper surface (see FIG. 7C). In addition, a determination value "30%" obtained by multiplying the density level 30% of the area P3 of the lower surface of the print sheet P by the weight coefficient "1" is obtained as a total value "30%" of the lower surface (see FIG. 7C). Then, the curling direction determination portion 83 compares the respective total values and determines, as the direction of curling, the direction in which the surface having a higher total value, namely, the direction in which the upper surface of the print sheet P faces in the image example of the FIG. 7B.

The rotation control portion 84 controls drive of the casing rotation motor 70 via the motor driver 96 to rotate the curling correction portion 60. Specifically, the rotation control portion 84 rotates the casing 65 of the curling correction portion 60 such that the curling correction portion 60 is set in either the first orientation or the second orientation so as to allow the curling in the print sheet P to be corrected in the direction opposite to the direction of the curling determined by the curling direction determination portion 83.

[Curling Correction Process]

Figure 8:
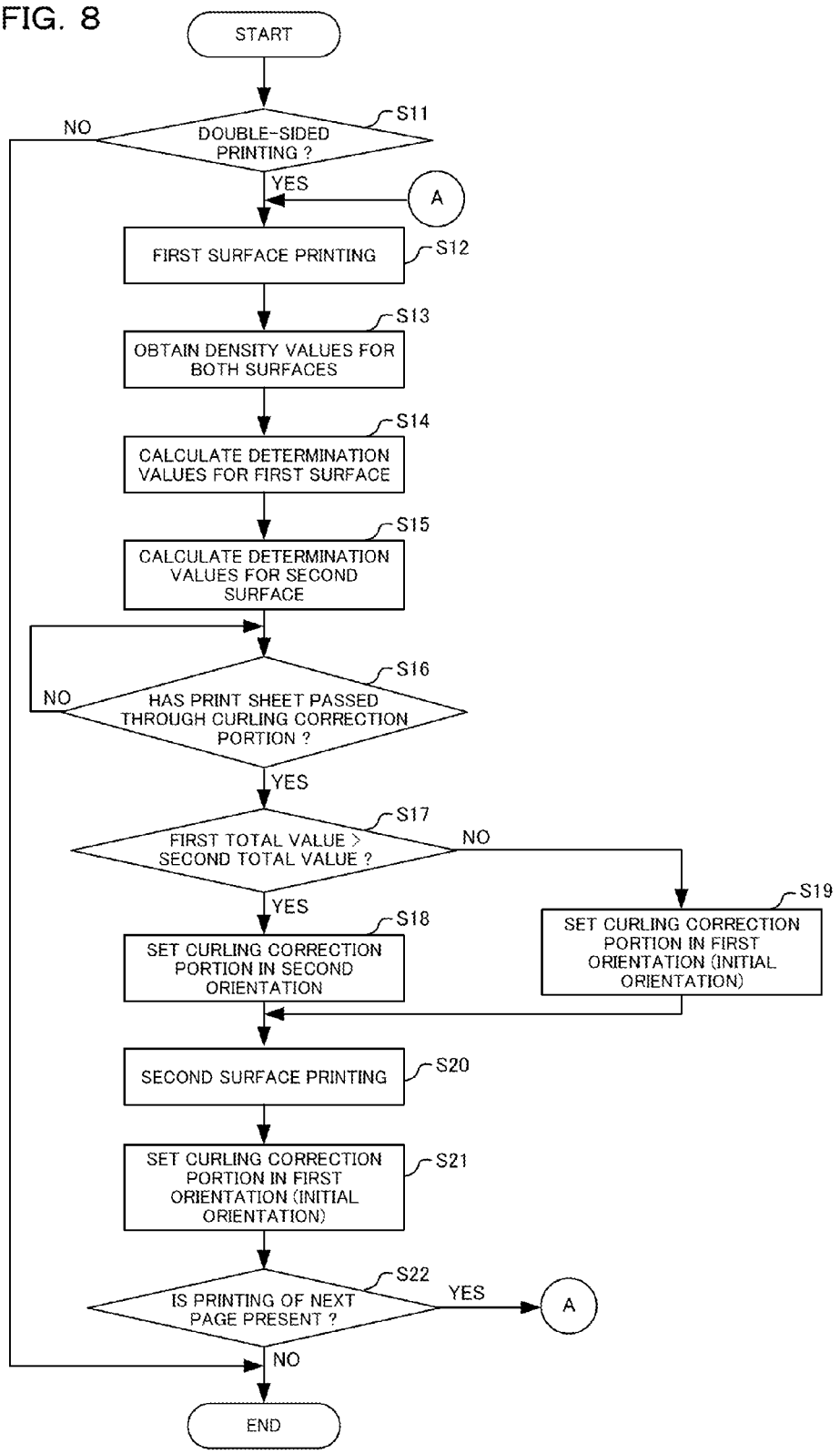
FIG. 8 is a flow chart showing one example of a curling correction process executed by the control portion shown in FIG. 5.

Hereinafter, the procedure of the curling correction process executed by the control portion 90 will be described with reference to a flow chart of FIG. 8. S11, S12, . . . in FIG. 8 represent process procedure (step) numbers. By the curling correction process being executed by the control portion 90 in accordance with the procedure, it is possible to accurately determine the direction of curling in the print sheet P, and by changing the orientation of the curling correction portion 60 to an orientation in which it is possible to correct the curling, it is possible to surely remove the curling in the print sheet P by the curling correction portion 60. In the following description, it is assumed that the image forming apparatus 10 is in a state where an instruction to form an image and image data have been inputted in the image forming apparatus 10. Moreover, the surface on which an image is formed during one-side printing, and the surface on which an image is firstly formed during double-sided printing will be referred to as a first surface. The surface on which an image is formed for the second time during double-sided printing will be referred to as a second surface.

In step S11, the control portion 90 determines whether the next image forming process is double-sided printing, based on the inputted image formation instruction. Specifically, when a print job is externally inputted as the image formation instruction, the control portion 90 determines whether the next image forming process is double-sided printing, based on whether double-sided printing is set as a printing condition included in the print job.

If it is determined in step S11 that the next image forming process is double-sided printing, the control portion 90 shifts the process to step S12 and performs first surface printing. Here, the first surface printing refers to an image forming process with respect to the first surface of the print sheet P. In the present embodiment, when the first surface printing is performed, the control portion 90 does not determine the direction of curling in the print sheet P, and performs the first surface printing with the curling correction portion 60 kept in an initial orientation. Here, the initial orientation of the curling correction portion 60 is an orientation in which the soft roller 62 is located on the first surface side when the first surface printing is performed, namely, the first orientation. When the first surface printing is performed, an image is formed on only a single surface, and thus the print sheet P curls toward the first surface side. Therefore, the first orientation in which it is possible to remove curling toward the first surface side is set as the initial orientation of the curling correction portion 60.

On the other hand, if it is determined in step S11 that the next image forming process is not double-sided printing, namely, is one-side printing, the control portion 90 does not determine the direction of curling in the print sheet P and performs the image forming process with the curling correction portion 60 kept in the initial orientation.

When the first surface printing is started in step S12, the control portion 90 obtains a density value for each of the areas P1 to P5 of each of both surfaces (the first surface and the second surface) of the print sheet P based on the inputted image data in the next step S13. The density value is obtained by the density obtaining portion 82 of the control portion 90. When double-sided printing is performed, image data to be formed on the first surface and image data to be formed on the second surface have been inputted to the image forming apparatus 10. Thus, the control portion 90 is able to obtain a density value of an image for each of the areas P1 to P5 of each surface from image density information included in each image data. It should be noted that as the method for obtaining a density value, various methods may be used, and, for example, it is also possible to obtain a density value based on a dot count value counted when image formation is performed. In addition, in the case where a density sensor which detects a density of a sheet surface on which image formation has been performed is provided, a density value may be obtained based on an output signal from the density sensor.

In the next step S14, the control portion 90 calculates the determination value of each of the areas P1 to P5 of the first surface of the print sheet P. Specifically, the determination value is calculated by multiplying each of the density values of the areas P1 to P5 of the first surface by the corresponding one of the weight coefficients K1 to K5. In addition, in step S15, the control portion 90 calculates the determination value of each of the areas P1 to P5 of the second surface of the print sheet P. Specifically, the determination value is calculated by multiplying each of the density values of the areas P1 to P5 of the second surface by the corresponding one of the weight coefficients K1 to K5.

Then, in the next step S16, the control portion 90 determines whether the print sheet P in which the image has been formed on the first surface thereof by the first surface printing has passed through the curling correction portion 60. Specifically, when the print sheet P has been conveyed by a distance by which the rear end of the print sheet P reaches the curling correction portion 60 after detection of the position of the leading end of the print sheet P based on a signal from the paper sheet sensor 20, the control portion 90 determines that the print sheet P has passed through the curling correction portion 60, based on the distance of the conveyance. It should be noted that after the print sheet P has passed through the curling correction portion 60, rotation of the curling correction portion 60 is enabled.

In the next step S17, the control portion 90 combines the determination values of the first surface which are calculated in step S14, to obtain a total value thereof (hereinafter, referred to as a "first total value"). In addition, the control portion 90 combines the determination values of the second surface which are calculated in step S15, to obtain a total value thereof (hereinafter, referred to as a "second total value"). Then, the control portion 90 compares these total values and determines whether the first total value is higher than the second total value.

Here, if the first total value is higher, even when second surface printing (an image forming process with respect to the second surface) is performed and images are formed on both surfaces, the print sheet P on which the second surface printing has been performed is more likely to curl toward the first surface side. Therefore, if the first total value is higher than the second total value, the control portion 90 determines that the print sheet P will curl toward the first surface side. The control portion 90 that performs such determination is an example of a curling direction determination portion of the present disclosure. In this case, before the second surface printing is performed, the print sheet P is turned upside down by the reverse conveyance path 29. Thus, the print sheet P conveyed in the conveyance path 28 after the second surface printing is performed has curled toward the first surface side, namely, downward in FIG. 2. Therefore, if it is determined in step S17 that the first total value is higher than the second total value, the control portion 90 changes the orientation of the curling correction portion 60 to the second orientation (the orientation in which the hard roller 61 is located on the heating roller 41 side) in step S18. Specifically, the control portion 90 supplies a control signal to the motor driver 96 to drive the casing rotation motor 70. By this, the control portion 90 rotates the casing 65 such that the orientation of the curling correction portion 60 is changed from the first orientation, which is the initial orientation, to the second orientation. Thereafter, the control portion 90 shifts the process to step S20.

On the other hand, if the first total value is lower than the second total value, the print sheet P is more likely to curl toward the second surface side by the second surface printing being performed. Therefore, if the first total value is lower than the second total value, the control portion 90 determines that the print sheet P will curl toward the second surface side. The control portion 90 that performs such determination is an example of the curling direction determination portion of the present disclosure. In this case, the print sheet P conveyed in the conveyance path 28 after the second surface printing is performed has curled toward the second surface side, namely, upward in FIG. 2. Therefore, if it is determined in step S17 that the first total value is lower than the second total value, the control portion 90 keeps the orientation of the curling correction portion 60 at the first orientation (the orientation in which the soft roller 62 is located on the heating roller 41 side) in step S19. Thereafter, the control portion 90 shifts the process to step S20. It should be noted that the control portion 90 that performs rotation control to make rotation such that the orientation of the curling correction portion 60 becomes the first orientation or the second orientation is an example of a rotation control portion of the present disclosure.

In the next step S20, the control portion 90 performs the second surface printing. Thereafter, in order to prepare for the next image formation, after the print sheet P in which an image has been formed on the second surface thereof by the second surface printing passes through the curling correction portion 60, the control portion 90 changes the orientation of the curling correction portion 60 to the first orientation or keeps the first orientation (S21). Then, if printing of the next page is present in the next step S22, the control portion 90 returns to step S12 and repeats the processes in and after step S12. On the other hand, if printing of the next page is not present, the control portion 90 ends a series of the processes.

In a typical existing apparatus including a curling removing device, in order to change the direction in which curling is corrected, a complicated operation is required in which a user visually confirms the direction of curling in a discharged print sheet and inputs an instruction to change the direction of correction to be made by the curling removing device. In addition, in the typical existing apparatus, not all curling in print sheets on which image formation has been performed can be removed. In addition, when images are formed on both surfaces of a print sheet, the direction of curling in the print sheet changes depending on the image density (the amount of fixed toner) of each surface. Thus, in the typical existing apparatus, curling in a print sheet in which images have been formed on both surfaces thereof cannot be surely corrected.

As described above, in the image forming apparatus 10 according to the present embodiment, the control portion 90 is able to accurately determine the direction of curling which occurs in the print sheet P in which images have been formed on both surfaces thereof. Thus, it is possible to change the orientation of the curling correction portion 60 to the orientation (the first orientation or the second orientation) in which it is possible to correct the curling in the print sheet P, thereby surely removing the curling that has occurred in the print sheet P.

It should be noted that the example where the areas P1 to P5 are set in the print sheet P, the determination value is obtained for each area, and the total values of the determination values of both surfaces of the print sheet P are compared has been described in the above-described embodiment, but the present disclosure is not limited thereto. For example, the print sheet P may be divided into four or less areas or six or more areas, a determination value may be obtained for each of the areas, a total value thereof may be obtained, and the total values of both surfaces may be compared. In addition, division areas may not be set in the print sheet P, and the direction of curling in the print sheet P may be determined based on a density value of the entire area of each of the first surface and the second surface of the print sheet P. In this case, a weight coefficient for the second surface on which an image is to be formed by the second surface printing to be performed later is preferably set so as to be higher than a weight coefficient for the first surface.

In addition, the weight coefficients K1 to K5 for the respective areas P1 to P5 are not limited to the values shown in the above-described embodiment. For example, with respect to a plurality of the print sheets P on which images have been formed on both surfaces thereof, a predetermined post-process such as a process of aligning the print sheets P, a stapling process, a punching process, or the like may be performed based on the leading end of each print sheet P in a discharge direction in which each print sheet P is discharged through the sheet discharge port 22. In this case, a weight coefficient for an area on the leading end side in the discharge direction of the print sheet P may be set so as to be higher than a weight coefficient for another area. In other words, the weight coefficient for the area on the leading end side is set high, in order that importance is placed on removal of curling on the leading end side in the discharge direction of the print sheet P rather than curling in the entirety of the print sheet P and it is possible to accurately determine the direction of curling at a leading end portion of the print sheet P. Similarly, when the predetermined post-process is performed based on the rear end of each print sheet P in the discharge direction, in which each print sheet P is discharged through the sheet discharge port 22, with respect to a plurality of the print sheets P in which images have been formed on both surfaces thereof, a weight coefficient for an area on the rear end side in the discharge direction of the print sheet P may be set so as to be higher than a weight coefficient for another area. In addition, after an image is formed on the second surface, the print sheet P may be curled by the curve of the conveyance path 28, which curves to the sheet discharge port 22. In this case, in order to be able to cancel curling by the curved conveyance path 28, a weight coefficient for the entirety of the surface opposite to the direction of curling by the conveyance path 28 may be set so as to be higher than a weight coefficient for the other surface.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image forming portion configured to form an image on either one of a first surface and a second surface, both of which are image formation surfaces, of a conveyed recording medium;

a reverse conveyance portion configured to reverse front and back sides of the recording medium after an image is formed on the first surface of the recording medium by the image forming portion, and convey the recording medium to the image forming portion in order to form an image on the second surface opposite to the first surface;

a curling correction portion including one pair of rollers composed of members that respectively have different elasticities and are pressed against each other, the curling correction portion being configured to correct curling that has occurred in the recording medium on which image formation has been performed by the image forming portion, by conveying the recording medium while nipping the recoding medium by the roller pair;

a rotation support portion supporting the curling correction portion such that the curling correction portion is rotatable about a rotation shaft parallel to a shaft of each roller of the roller pair in such a manner as to allow positions of the rollers to be reversed;

a driving portion configured to rotate the rotation support portion;

a curling direction determination portion configured to determine a direction of curling in the recording medium to which images are formed on both surfaces thereof by the image forming portion, based on an image density of each of both surfaces of the recording medium to which the images are formed on both surfaces thereof; and a rotation control portion configured to control drive of the driving portion to rotate the curling correction portion such that the curling correction portion is set in an orientation for correcting the curling that occurs in the recording medium, in a direction opposite to the direction of the curling determined by the curling direction determination portion, wherein the image formation surface of the recording medium is divided into a plurality of division areas, and the curling direction determination portion obtains, for each of the first surface and the second surface, a plurality of determination values obtained by multiplying an image density value of each of the plurality of division areas of the image formation surface of the recording medium by a weight coefficient which is set so as to correspond to each division area, further obtains a total value of the plurality of determination values for each surface, and determines, as the direction of the curling in the recording medium, a direction in which the surface having a higher total value faces.

2. The image forming apparatus according to claim 1, wherein the plurality of division areas are areas obtained by dividing from a first end portion on a downstream side to a second end portion on an upstream side in a conveying direction of the recording medium, and the weight coefficients are set to become higher from a center portion in the conveying direction of the recording medium toward the first end portion and the second end portion.

3. The image forming apparatus according to claim 1, wherein the roller pair includes a soft roller formed from a flexible material and a hard roller formed from a harder material than that of the soft roller, and when image formation is performed on the first surface of the recording medium, the curling correction portion is set in an orientation in which the soft roller is located on the first surface side.

* * * * *